US008919778B2

(12) United States Patent
Fodera

(10) Patent No.: US 8,919,778 B2
(45) Date of Patent: Dec. 30, 2014

(54) FRANGIBLE TARGET SUSPENSION APPARATUSES AND METHODS OF USE THEREOF

(76) Inventor: Daniel L. Fodera, Evans, GA (US)

( * ) Notice: Subject to any disclaimer, the term of this patent is extended or adjusted under 35 U.S.C. 154(b) by 290 days.

(21) Appl. No.: 13/418,838

(22) Filed: Mar. 13, 2012

(65) Prior Publication Data

US 2013/0241152 A1 Sep. 19, 2013

(51) Int. Cl.
*F41J 1/10* (2006.01)

(52) U.S. Cl.
USPC ..... 273/407; 273/380

(58) Field of Classification Search
USPC ..... 273/403–410, 380, 390–392; 40/617; 446/314, 315
See application file for complete search history.

(56) References Cited

U.S. PATENT DOCUMENTS

| | | | | | |
|---|---|---|---|---|---|
| 1,009,409 | A * | 11/1911 | Harding | 40/605 |
| 1,723,826 | A * | 8/1929 | Van Auken | 273/380 |
| 2,509,059 | A * | 5/1950 | Hirschhorn | 40/617 |
| 3,647,214 | A * | 3/1972 | Hohmann | 273/392 |
| 3,676,942 | A * | 7/1972 | Elrod | 40/124.2 |
| 4,921,250 | A * | 5/1990 | Ayres | 273/380 |
| 5,423,142 | A * | 6/1995 | Douglas et al. | 40/605 |
| 5,577,734 | A * | 11/1996 | Conroy | 273/407 |
| 5,632,491 | A * | 5/1997 | Hamas | 273/407 |
| 6,913,263 | B2 * | 7/2005 | Fort, II | 273/406 |
| 7,422,217 | B2 * | 9/2008 | Hinnant | 273/407 |
| 7,644,927 | B2 * | 1/2010 | Law | 273/407 |
| 7,681,887 | B2 * | 3/2010 | Hensley | 273/407 |
| 7,789,080 | B2 * | 9/2010 | Fielding, Jr. | 124/27 |
| 7,845,646 | B1 * | 12/2010 | Weber | 273/407 |
| 7,946,588 | B1 * | 5/2011 | Hockman et al. | 273/406 |
| 2008/0088089 | A1 * | 4/2008 | Bliehall et al. | 273/359 |
| 2012/0068412 | A1 * | 3/2012 | Diercks | 273/407 |

* cited by examiner

*Primary Examiner* — Mark Graham
(74) *Attorney, Agent, or Firm* — Mathew L. Grell; Balser & Grell IP Law

(57) ABSTRACT

A frangible target suspension apparatus wherein the frangible targets are secured to one or more support cords by passing the support cord through apertures in the side edges of the frangible targets and using tension caused by the weight to keep the frangible targets in place on the support cord, or by securing with adhesive, such as when the support cord is a tape, or by knotting the support cord, or utilizing a fastener to secure the support cord to the frangible target. In an alternative embodiment, the frangible target engages a cover with side slots that is placed over the frangible target from the rear retaining the support cord in place within the side slots.

11 Claims, 9 Drawing Sheets

FRANGIBLE TARGET SUSPENSION APPARATUSES AND METHODS OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to apparatuses for suspending targets, and more specifically to apparatuses for suspending frangible targets for shooting practice.

2. Description of Related Art

In order to obtain practice in firing a weapon and to become proficient in shooting, it is typical for a shooter to fire weapons at targets positioned remotely from the shooter's firing position. In many cases, such targets are fixed. In other cases, the targets are in motion.

Fixed targets typically comprise a round target area or a figure profile, and are often comprised of paper attached to a standard target frame, either directly or via a cardboard backing. Moving targets are usually profiles located at a fixed remote position, but, often, comprise frangible objects flung through the air via a throwing mechanism. The frangible objects are typically disk shaped and are made from chalk, clay or similar materials.

In the former case of a fixed profile paper target, it is often difficult to determine where on the target a shot hit, and with very distant targets is often even difficult to determine whether the shot hit the target at all. However, with the latter case, because of the frangible nature of the target, it is usually quite easy to see that the target has been struck by a bullet or shot, because the target breaks apart, often quite spectacularly.

Thus, frangible targets are particularly suited to fixed use when it is desired to see immediate visual confirmation of a shot striking the target. In such a use, the frangible target is often held in a stand on which the target rests, or is supported via a wire or hangers that connect to a rigid or flexible frame, or is retained within cutouts in cardboard holders. In some instances, the target may even be stood upon the ground or secured by wire to a standard target frame.

With individual targets, the shooter must place each target when needed by standing, hanging, inserting, attaching, or otherwise connecting the target to a target holding device. When a new target is needed, the shooter must replace the no longer present original one, and must do so repeatedly as necessary. Putting up a new target takes up valuable range time, when a shooter would prefer to be practicing, rather than installing targets.

Moreover, existing target holders are often damaged or destroyed by a misplaced shot. When such occurs, the target holder must be replaced before the shooter can continue his/her practice or competition.

Existing target holding devices take up space and require setup time. When a shooter wants to vary his/her practice with both paper and frangible targets, the shooter must utilize separate target holding devices for each type of target.

When targets, such as flat paper profiles, are transported, they take up very little space. Frangible targets are often constructed in a shape for stacking one on top of the other to minimize space requirements when not in use. Both types of targets are typically sold separately from their supporting devices, inconveniencing the purchaser by having to go to different sources, and providing less benefit to a manufacturer than would be achieved by providing a combination product to a user.

Various attempts have been made to overcome some of the aforementioned deficiencies. One previous target holding device is a housing sleeve for storing frangible targets with mounting feature for hanging the housing sleeve. The housing sleeve is adapted to store multiple targets in a vertical orientation, with targets sitting one above the other, with the bottom target exposed. Once the exposed target is destroyed, the next target in line drops down into the exposed region. Movement of the targets within the sleeve is controlled by utilizing a disk-shaped stopping feature, such as a washer, which prevents the lowermost target from dropping below a certain point. Because the targets are contained within a sleeve, the sleeve impedes stacking of the targets in a volume-efficient manner before use. Thus, this device is best suited to separate installation followed by addition of discrete frangible targets once the sleeve is suspended. Moreover, this device lacks a means for suspension in other than a vertically-hanging aspect.

Another previous device comprises horizontal cords from which shooting targets are hung. However, the shooting targets must first be secured to a holding arm before being hung from the cord, as the cord and targets are not integrated.

Yet another previous similar device suspends the targets via an arm suspended from a horizontal rod. However, because the rod is stiff, it prevents an assembly of the rods and targets from being efficiently stacked to minimize volume during transport and storage.

Therefore, it is readily apparent that there is a need for a target suspension apparatus that can be preassembled and efficiently stacked for transport and storage prior to use, but which when installed and used also provides a ready indication to a shooter of a shot impact the via the use of a frangible target.

BRIEF SUMMARY OF THE INVENTION

Briefly described, in a preferred embodiment, the present invention overcomes the above-mentioned disadvantages and meets the recognized need for such a device by providing a frangible target suspension apparatus wherein the frangible targets are secured to one or more support cords by passing the support cord through apertures in the side edges of the frangible targets and using tension caused by the weight to keep the frangible targets in place on the support cord, or by securing with adhesive, such as when the support cord is a tape, or by knotting the support cord, or utilizing a fastener to secure the support cord to the frangible target. In an alternative embodiment, the frangible target has side slots that cooperatively engage slots in a cover placed over the frangible target from the rear retaining the support cord in place. In order to maintain the face of the frangible target in a vertical disposition facing a shooter, portions of the support cord are selectively secured at a high point on both of the opposite edges of each of the frangible targets.

According to its major aspects and broadly stated, the present invention in its preferred form is a frangible target suspension apparatus comprising one or more frangible targets secured at their sides to one or more support cords. The frangible targets are suspended from the support cord and may hang vertically or be secured in a horizontal disposition. The support cord is secured to the frangible targets by passing the support cord through apertures in the sides or edges of the frangible targets, wherein tension caused by the weight of the frangible targets binds the support cord to the frangible targets via contact of the support cord with the apertures. Further, the support cord may selectively pass under a bottommost target to provide additional support.

Alternatively, the support cord is secured to the frangible targets via adhesive, or may be secured by knots in the support cord below the lower aperture, by beads secured to the support cord below the lower aperture, or by clips or plugs which respectively clip to or plug into the apertures, and to which the support cord is secured.

In another alternative, the support cord comprises a tape adhesively secured to the edges of the frangible target and in yet another alternative, the support cord is molded within the frangible target when the frangible target is made.

The support cord may selectively comprise a single support cord having an apex for securing to a fastener affixed to a frame, or may selectively comprise two support cords that are independently secured to a frame over a fastener.

In another alternative, the frangible targets are retained by engagement with forward-facing slots in a cover/sleeve that is secured to the rear of the frangible target after the support cord is disposed in the forward-facing slots. Accordingly, the support cord is retained by the combination of the slots against the frangible target, thereby securing the frangible targets to the support cord. Additionally, a lip on the cover/sleeve is disposed over a portion of the front of the frangible target further securing the frangible target within the cover/sleeve.

In use, the frangible targets are secured to the support cord at their opposite edges as described above, and, subsequently, are secured to a frame by the support cord, wherein the frangible targets hang suspended from the support cord.

More specifically, the present invention is preferably a frangible target suspension apparatus comprising frangible disks and support cords, wherein the frangible disks have an inside, an upper throughhole and a lower throughhole. The support cord has an apex for attachment of the frangible target suspension apparatus by securing the apex over a peg or nail on a supporting frame.

The support cord passes through the upper throughhole to the inside of the frangible disk and then passes from the inside through the lower throughhole, thereby retaining the frangible disk on the support cord. The bottommost disk has a bottom edge and the support cord has a lower bend that passes along the bottom edge, thereby supporting the bottommost disk on the support cord. Weight of the bottommost disk pulls the support cord taught, engaging the support cord in the upper and lower throughholes, wherein the frangible disks are frictionally retained on the support cord by contact of the support cord with the throughholes. The frangible disks and support cord preferably comprise biodegradable materials.

Different methods of securing the support cords to the frangible disks are utilized, depending upon whether a single support cord or separate support cords suspend the frangible disks. Particularly, the frangible disks each have a right edge and a left edge and the support cords may be secured to the edges via adhesive. The support cord may selectively be secured at a high point to provide better control of the disposition of the frangible disk, particularly to maintain the frangible disk in a vertical disposition. Particularly, when secured at the high point, the weight of the frangible disk will pull the frangible disk into a vertical disposition. When adhesive is utilized, it is preferable that the support cord comprise a tape to allow greater surface area. The support cord may also selectively pass under the bottom edge of the frangible disk.

Below the lower throughholes, a knot may selectively be tied in the support cords, thereby preventing the frangible disk from sliding downward on the support cords under the influence of gravity. Alternatively, beads or crimpable tubes may be affixed to the support cord below the lower throughholes. In another alternative, pegs may be inserted into the upper and/or lower throughholes and frictionally retained therein, capturing the support cord, which may pass inside the frangible disk or may pass along the outside edges. Clips may also be utilized to clip to both the support cords and the throughholes, thereby retaining the frangible disks in position.

The frangible disk may selectively have a groove in the sides thereof, wherein the groove is dimensioned to receive the support cord, and wherein the support cord is inserted by pressing sideways into the groove. The frangible disk may also be molded onto the support cord when the frangible disk is manufactured.

In an alternative embodiment, the support cords are positioned over the back of the target. Subsequently, a cover with front-facing slots is secured over disk, thereby locking the frangible disk to the support cords and retaining the frangible disk and cover on the support cord, thereby preventing the frangible disk from sliding on the support cord.

In an alternative embodiment, the frangible disks and support cords are secured in a horizontal disposition, wherein the support cords have loops at the ends thereof, and wherein the loops are secured over any suitable fastener, such as, for exemplary purposes only, a plurality of hanging pegs/nails.

The frangible target suspension apparatus may be embodied as a multi-strand frangible target support having a plurality of frangible disks staggered in height and supported by outer support cords and inner support cords, to form two or more columns of targets.

The frangible target suspension apparatus is readily stored and transported by stacking the frangible disks one on top of the other. Thus, space is conserved and the close proximity of the frangible disks to each other fixes each in position, thereby preventing damage to the frangible disks during transport.

To use, the frangible target suspension apparatus is placed in service by disposing the apex over hanging pegs/nails on a frame, and, where securing loops are provided, by securing the loops via a suitable fastener, such as, for exemplary purposes only, pegs/nails affixed to the rails of the frame. Accordingly, the frangible target suspension apparatus is best suited to utilize against a substrate to which it is secured. In an alternate embodiment of a frangible target suspension apparatus, the loops are replaced with weights. In a further alternate embodiment, the support cords and loops could incorporate a tensioning device, such as, for exemplary purposes only, a bungee cord.

Once the frangible target suspension apparatus is secured to a frame, a target shooter proceeds a selected distance from the frangible target suspension apparatus, aims his/her weapon at a selected one of the frangible disks and commences firing, thereby destroying the selected frangible disk.

The remaining frangible disks continue to be suspended on the support cord and may subsequently be targeted by the shooter.

Accordingly, a feature and advantage of the present invention is its ability to provide quick visual indication of a shot striking a target.

Another feature and advantage of the present invention is its ability to be suspended vertically, horizontally or at any angle in between.

Still another feature and advantage of the present invention is its ability to be preassembled and ready for use.

Yet another feature and advantage of the present invention is its ability to utilize a variety of materials for suspending frangible targets.

Yet a further feature and advantage of the present invention is its ability to utilize a variety of methods for attaching frangible targets to a support material.

Yet still another feature and advantage of the present invention is ability to be efficiently stacked for storage and/or transportation while taking up a minimum of space.

A further feature and advantage of the present invention is that it could be made of biodegradable materials.

Still a further feature and advantage of the present invention is that it maintains the target face directed toward the shooter.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1-17B, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
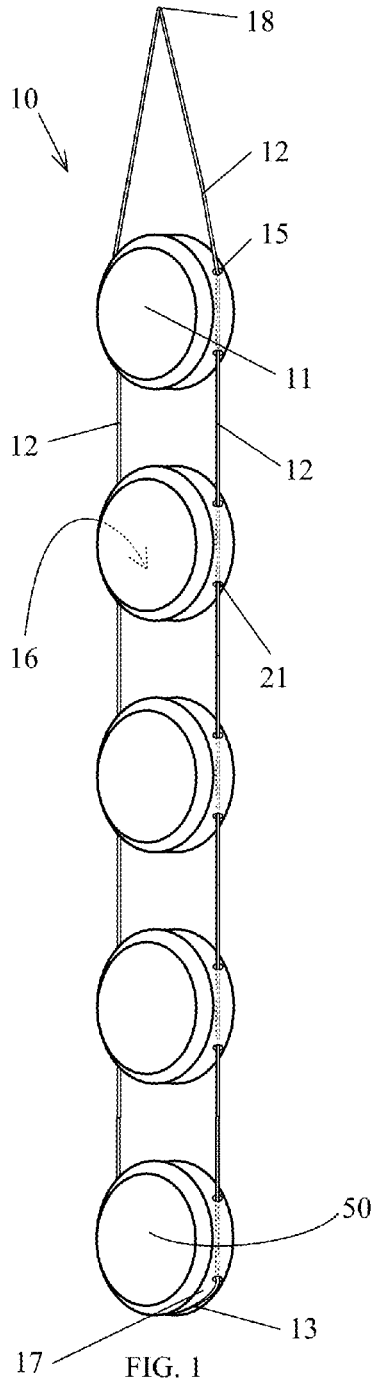
FIG. 1 is a perspective view of a frangible target suspension system with targets according to a preferred embodiment, shown suspended vertically.
Figure 13:
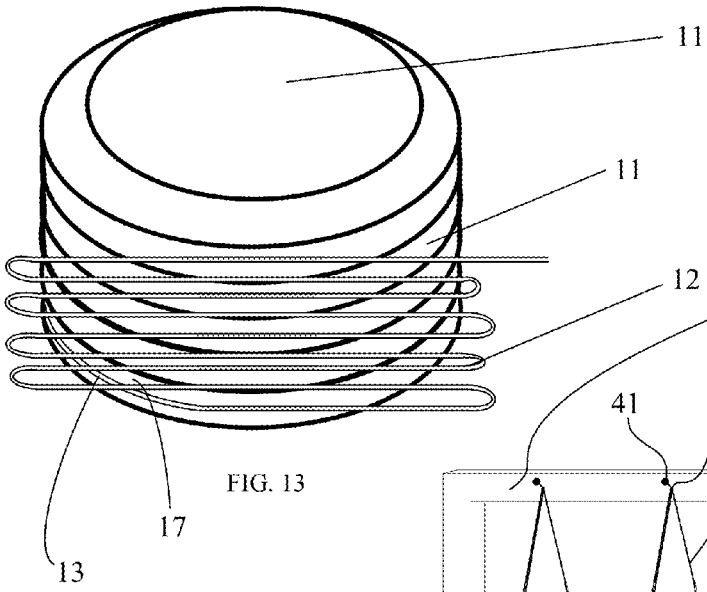
FIG. 13 is a perspective view of a frangible target suspension system according to the preferred embodiment of FIG. 1, shown with targets stacked for storage or transport.
Figure 14:
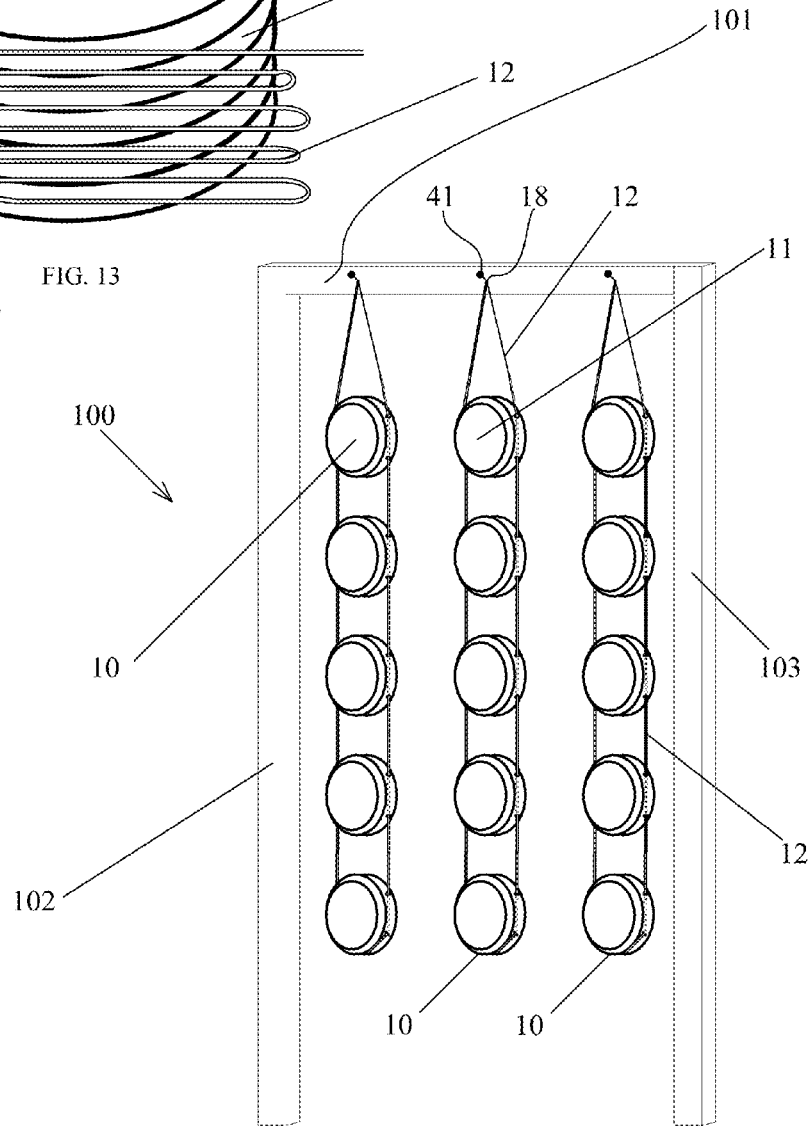
FIG. 14 is a perspective view of a set of multiple frangible target suspension systems according to the preferred embodiment of FIG. 1, shown installed on a support frame.

Referring now to FIGS. 1, 13 and 14, the present invention in a preferred embodiment is frangible target suspension apparatus 10 comprising frangible targets 11 and support cord 12, wherein frangible targets 11 comprise inside 16, upper throughhole 15 and lower throughhole 21, and wherein support cord 12 comprises apex 18, and wherein apex 18 provides for attachment of frangible target suspension apparatus 10, by securing support cord 12 over hanging peg/nail 41 (best shown in FIG. 14).

Support cord 12 passes through upper throughhole 15 to inside 16 of frangible target 11 and then passes from inside 16 through lower throughhole 21, wherein frangible target 11 is retained on support cord 12. Bottommost disk 50 of frangible targets 11 comprises bottom edge 17 and support cord 12 comprises lower bend 13, wherein lower bend 13 passes along bottom edge 17, thereby supporting bottommost disk 50 on support cord 12. It will be recognized by those skilled in the art that frangible targets 11 could comprise any suitable shape other than a disk shape without departing from the spirit of the preferred embodiment. Weight of bottommost disk 50 pulls support cord 12 taught, engaging support cord 12 in upper and lower throughholes 15, 21, wherein frangible targets 11 are frictionally retained by contact of support cord 12 with throughholes 15, 21, and wherein frangible targets 11 are retained in position on support cord 12 by frictional contact.

Frangible targets 11 and support cord 12 preferably comprise biodegradable materials. It will be recognized by those skilled in the art that frangible targets 11 and support cord 12 could comprise materials other than biodegradable materials without departing from the spirit of the preferred embodiment.

In use, frangible target suspension apparatus 10 is secured to frame 100 (best shown in FIG. 14), wherein frame 100 comprises top rail 101, left rail 102 and right rail 103, and wherein frangible target suspension apparatus 10 is secured by disposing apex 18 over a suitable protrusion, such as, for exemplary purposes only, hanging peg/nail 41. A target shooter then proceeds a selected distance from frangible target suspension apparatus 10, aims his/her weapon at a selected one of frangible targets 11 from among those comprising frangible target suspension apparatus 10 and commences firing, thereby destroying selected frangible target 11. The remaining frangible targets 11 of frangible target suspension apparatus 10 continue to be suspended on support cord 12 and may subsequently be targeted by the shooter.

Frangible target suspension apparatus 10 is readily stored and transported by stacking frangible targets 11 one on top of the other (best shown in FIG. 13). Thus, space is conserved and close proximity of frangible targets 11 to each other fixes each in position, thereby preventing damage to frangible targets 11 during transport.

Different methods of securing support cords 12 to frangible targets 11 could be utilized, whether a single support cord 12 or separate support cords 12 suspend frangible targets 11. Particularly, in the alternate embodiments depicted in FIGS. 4-6, frangible target 11 comprises right edge 31 and left edge 32, wherein right edge 31 and left edge 32 are on opposite sides of frangible target 11, and wherein frangible target 11 is secured to support cords 12 via adhesive 39, and wherein adhesive 39 is disposed on right and left edges 31, 32, and wherein support cords 12 are retained by adhesive 39. More particularly, in the alternate embodiment depicted in FIG. 4, single support cord 12 is adhesively secured to frangible target 11; in the alternate embodiment depicted in FIG. 5, two separate support cords 12 are adhesively secured one each to right and left edges 31, 32 of frangible target 11; and in the alternate embodiment of FIG. 6, support cord 12 is adhesively secured to a plurality of frangible targets 11 comprising at least upper disk 60 and bottommost disk 50, wherein bottommost disk 50 is secured via adhesive 39 to support cord 12, and wherein support cord 12 is secured at high point 70 to provide better control of vertical disposition of bottommost disk 50. Particularly, since bottommost disk 50 is secured at high point 70, weight of bottommost disk 50 will cause bottommost disk 50 to assume a vertical disposition. It will be recognized by those skilled in the art that other frangible targets 11 could have support cord 12 secured at high point 70 to facilitate maintenance of a vertical disposition. Bottommost disk 50 comprises bottom edge 17 and support cord 12 comprises lower bend 13, wherein lower bend 13 passes proximate bottom edge 17 and may be selectively secured to bottom edge 17 via adhesive 39.

Further alternate embodiments for securing frangible targets 11 to support cords 12 are depicted in FIGS. 7-12. Particularly, in FIG. 7, frangible target 11 comprises right edge 31 and left edge 32, wherein right edge 31 comprises upper throughhole 15 and lower throughhole 21, and wherein left edge 32 comprises upper throughole 15 and lower throughhole 21 (not shown), and wherein support cords 12 pass through upper throughholes 15 to inside 16 and from inside 16 through lower throughholes 21, and wherein support cords 12 comprise knots 33 disposed below lower throughholes 21. Knots 33 prevent frangible target 11 from sliding downward on support cords 12 under the influence of gravity.

Figure 8:
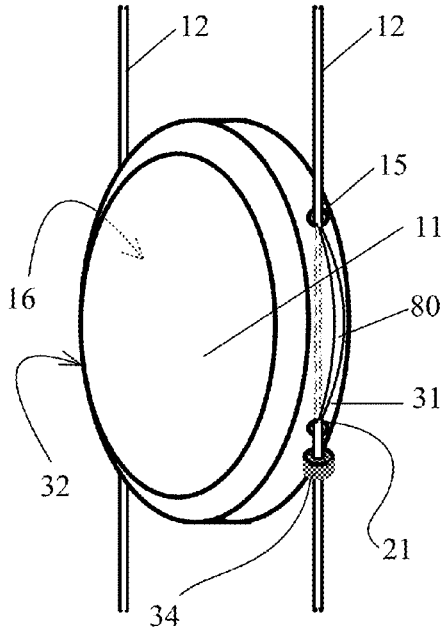
FIG. 8 is a perspective view of a suspended frangible target according to an alternate embodiment having suspending cords secured to the target by insertion into retaining grooves in the sides of the target, shown with a lower retaining bead or crimpable tube.

Turning now more particularly to FIG. 8, frangible target 11 comprises right edge 31 and left edge 32, wherein right edge 31 comprises slot 80 therein, and wherein left edge 32 comprises slot 80 therein (not shown), and wherein frangible target 11 is disposed on support cords 12, and wherein support cords 12 are inserted into frangible target 11 by pressing sideways into slots 80. Frangible target 11 may selectively comprise upper throughholes 15 and lower throughholes 21, wherein after insertion via slot 80, support cords 12 pass through upper throughholes 15 to inside 16 and from inside 16 through lower throughholes 21. Bead 34 is disposed on support cords 12 below lower throughholes 21, wherein bead 34 is secured to support cord 12 via any means known in the art, and wherein bead 34 retains frangible target 11 in position on support cord 12 and prevents frangible target 11 from sliding downward on support cords 12 under the influence of gravity. It will be recognized by those skilled in the art that bead 34 could be replaced by a crimpable tube.

Figure 9:
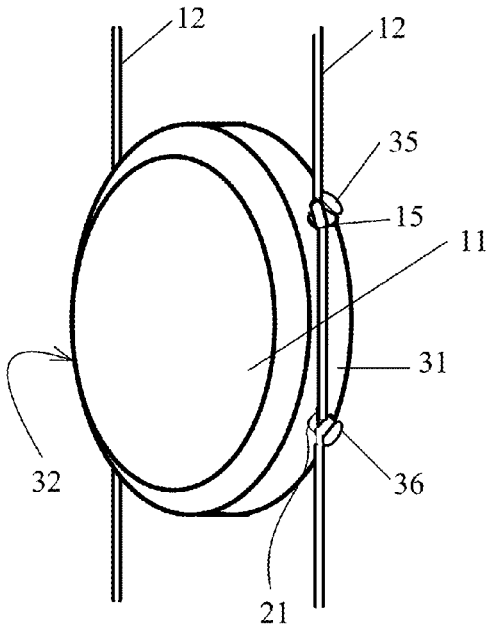
FIG. 9 is a perspective view of a suspended frangible target according to an alternate embodiment having suspending cords secured to the target by passing over the sides of the target, shown with retaining plugs or clips.

Turning now to FIG. 9, frangible target 11 comprises right edge 31, left edge 32, upper throughholes 15 and lower throughholes 21, wherein support cords 12 pass over edges 31, 32, and wherein frangible target 11 is disposed on support cords 12. Upper pegs 35 is may be selectively disposed within upper throughholes 15 and lower pegs 36 may be selectively disposed within lower throughholes 21, wherein support cords 12 are secured to pegs 35, 36 by tying or looping support cords 12 over pegs 35, 36, and wherein upper and lower throughholes 15, 21 are dimensioned to frictionally receive pegs 35, 36, respectively, and wherein upper pegs 35 and/or lower pegs 36 secure support cord 12 on frangible target by pressing upper pegs 35 and/or lower pegs 36 into upper throughholes 15 and/or lower throughholes 21, respectively. Upper pegs 35 and/or lower pegs 36 retain frangible target 11 in position on support cord 12 and prevent frangible target 11 from sliding downward on support cords 12 under the influence of gravity. Alternatively, pegs 35, 36 may engage support cords 12 and retain support cords 12 in contact with frangible target 11, while pegs 35, 36 are frictionally retained in throughholes 15, 21, respectively.

Figure 10:
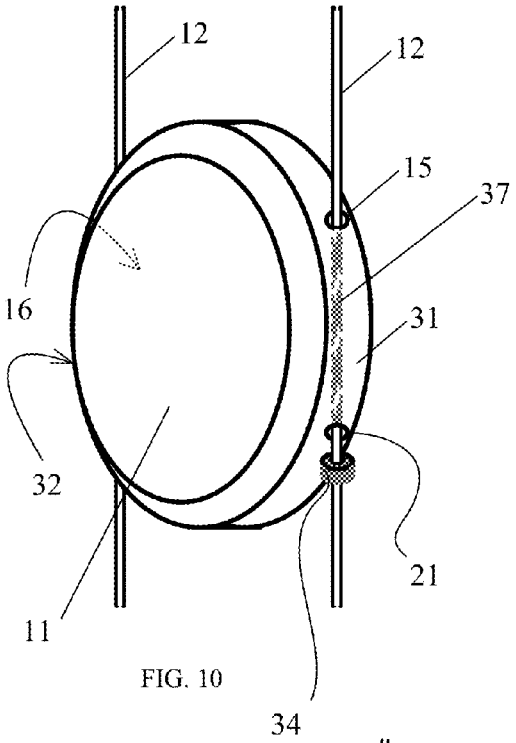
FIG. 10 is a perspective view of a suspended frangible target according to an alternate embodiment having suspending cords secured to the target by passing through apertures in the sides of the target, shown with a retaining bead or crimpable tube.

In FIG. 10, frangible target 11 comprises right edge 31 and left edge 32, wherein right edge 31 comprises upper throughhole 15 and lower throughhole 21, and wherein left edge 32 comprises upper throughole 15 and lower throughhole 21 (not shown), and wherein support cords 12 pass through upper throughholes 15 to inside 16 and from inside 16 through lower throughholes 21, with section 37 of support cords 12 being disposed within inside 16. Bead 34 is disposed on support cords 12 below lower throughholes 21, wherein bead 34 is secured to support cord 12 via any means known in the art, and wherein bead 34 retains frangible target 11 in position on support cord 12 and prevents frangible target 11 from sliding downward on support cords 12 under the influence of gravity.

Figure 11:
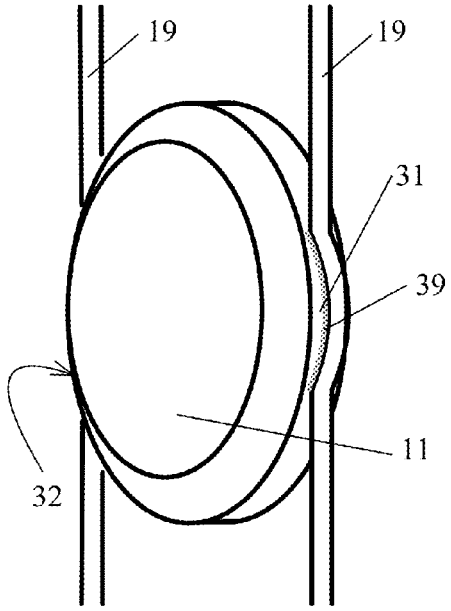
FIG. 11 is a perspective view of a suspended frangible target according to an alternate embodiment having suspending tapes adhesively secured to the target on both sides.

Turning now more particularly to FIG. 11, frangible target 11 comprises right edge 31 and left edge 32. Support tapes 19 are secured to right edge 31 and left edge 32 via adhesive 39, wherein frangible target 11 is adhesively secured to support tapes 19.

Figure 12:
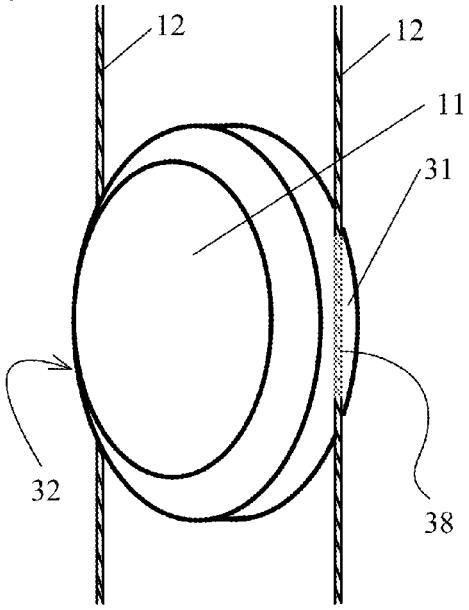
FIG. 12 is a perspective view of a suspended frangible target according to an alternate embodiment having suspending cords secured to the target by inclusion during molding of the target.

Turning now to FIG. 12, frangible target 11 comprises right side 31 and left side 32. Support cords 12 are disposed within right side 31 and left side 32 during molding of frangible target 11, thereby fixedly securing support cords 12 within molded sections 38.

Figure 16A:
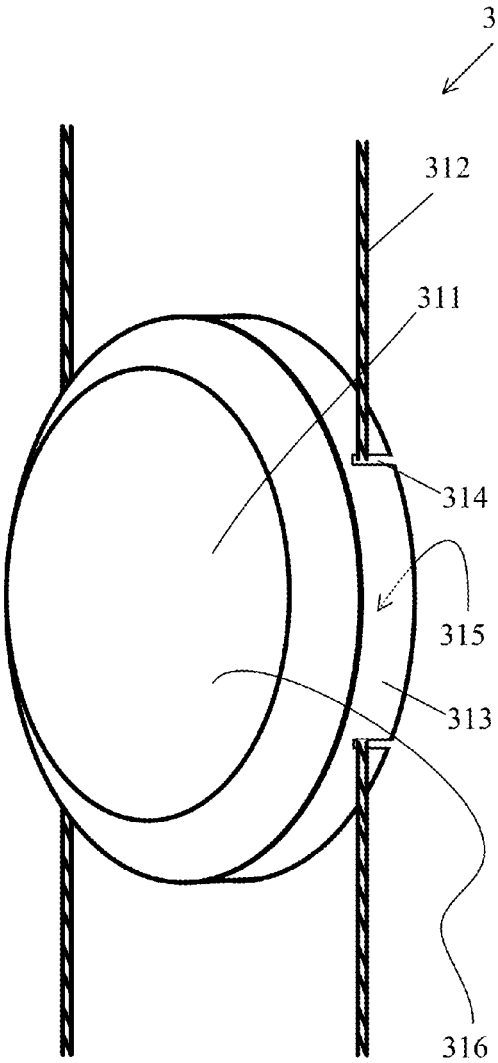
FIG. 16A is a front perspective view of a suspended frangible target according to an alternate embodiment having suspending cords removably secured to the target sides via rear-facing slots.
Figure 16B:
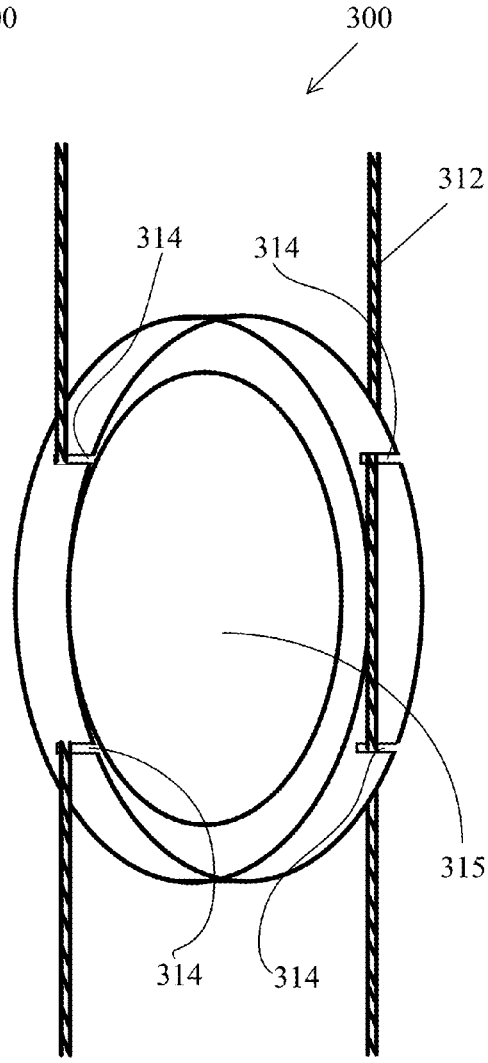
FIG. 16B is a perspective view of the frangible target and cords of FIG. 16A rotated left ninety degrees.

Referring now more specifically to FIGS. 16A-16B, illustrated therein is an alternate embodiment of frangible target suspension apparatus 10, wherein the alternate embodiment of FIGS. 16A-16B is substantially equivalent in form and function to that of the preferred embodiment detailed and illustrated in FIGS. 1, 13 and 14 except as hereinafter specifically referenced. Specifically, in the embodiment of FIGS. 16A-16B, alternative frangible target suspension apparatus 300 comprises frangible targets 311 having front 316, inside 315 and periphery 313, wherein periphery 313 comprises first slots 314 therein, and wherein first slots 314 are disposed over support cords 312, and wherein when support cords 312 are pulled taught by weight of disks 311, support cords 312 bind in first slots 314, thereby retaining disks 311 in their selected position on support cords 312.

Figures 17A, 17B:
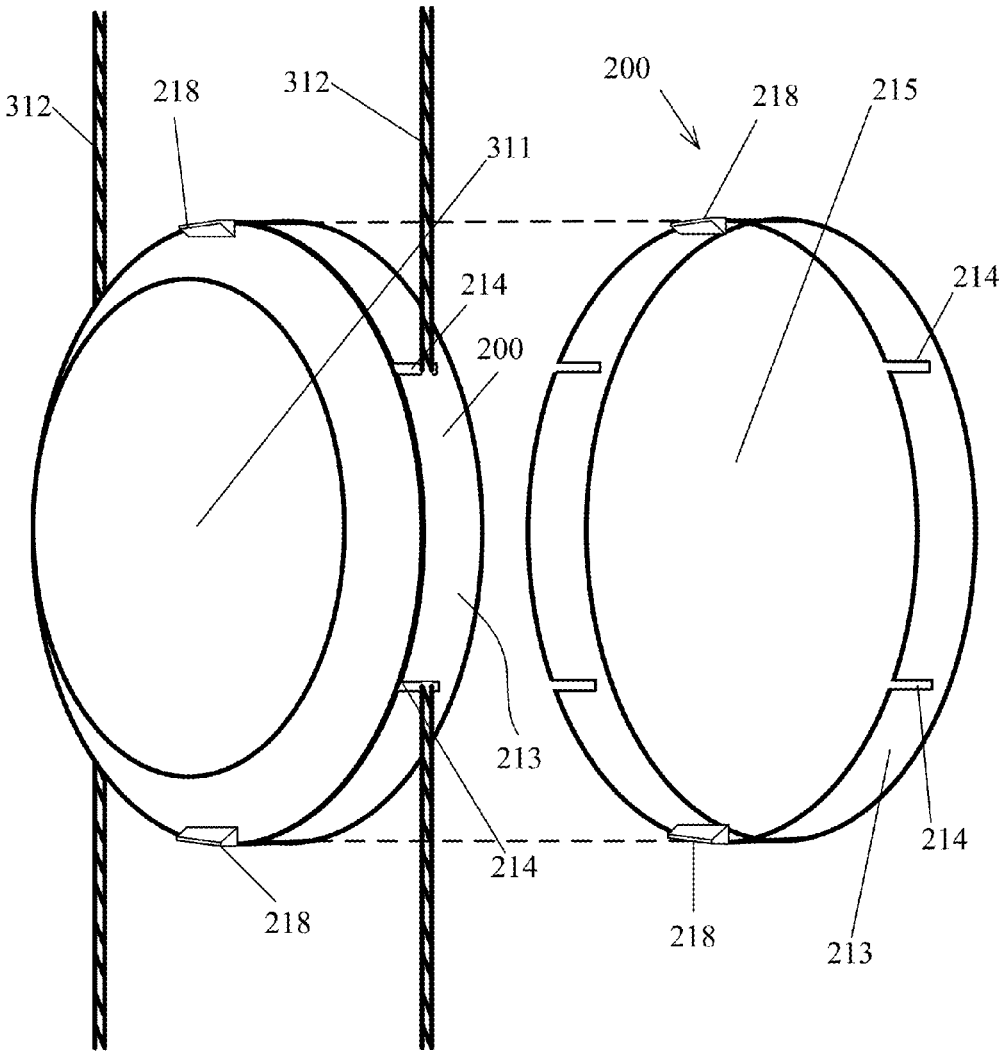
FIG. 17A is a front perspective view of a suspended frangible target according to the alternate embodiment of FIG. 16A having the suspending cords retained via a sleeve attached from the rear of the frangible target.
FIG. 17B is a front perspective view of the cover shown exploded off the suspended frangible target of FIG. 17A.

In a further modification of the alternate embodiment of FIGS. 16A-16B, as depicted in FIG. 17A-17B, frangible targets 311 are secured to support cords 312 as set forth hereinabove for the alternate embodiment of FIGS. 16A-16B. Subsequently, sleeve 200, comprising periphery 213, second slots 214 and inside 215 is secured over disk 311, wherein periphery 213 is disposed proximate periphery 313 (best shown in FIG. 16A), thereby locking support cords 312 within slots 214, and retaining frangible target 311 and cover 200 on support cord 312 and preventing frangible target 311 from sliding on support cord 312. Sleeve 200 further includes lips 218 to keep frangible target 311 from falling out.

Figure 2:
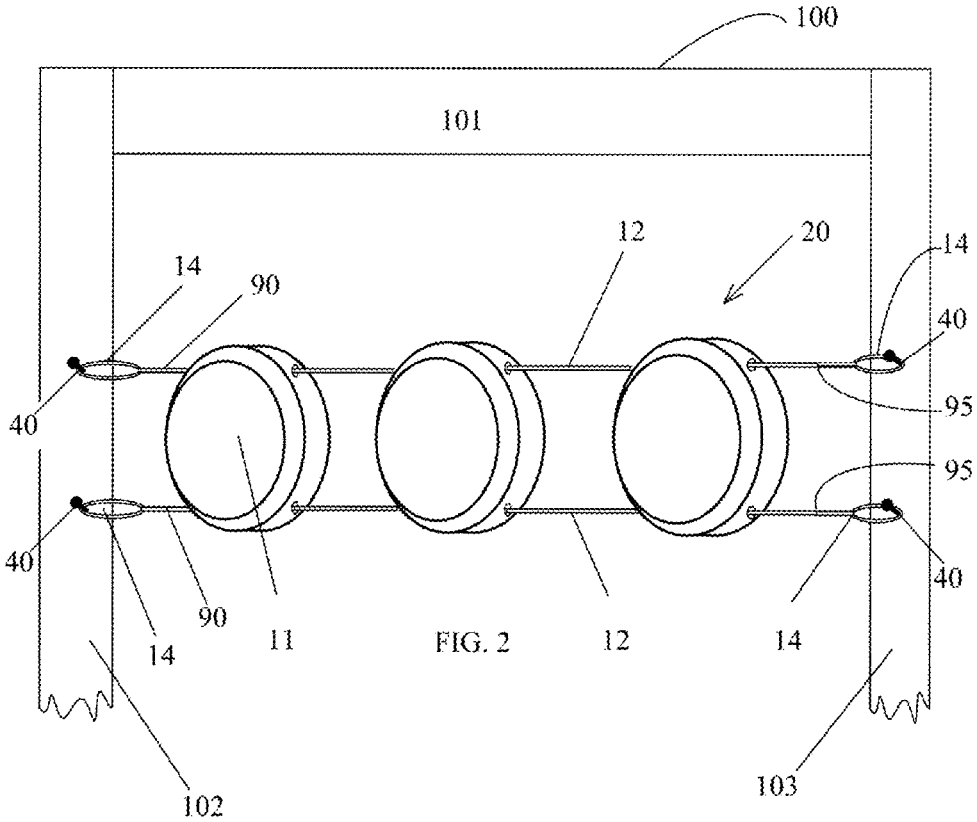
FIG. 2 is a perspective view of a frangible target suspension system with targets according to an alternate embodiment, shown suspended horizontally.
Figure 4:
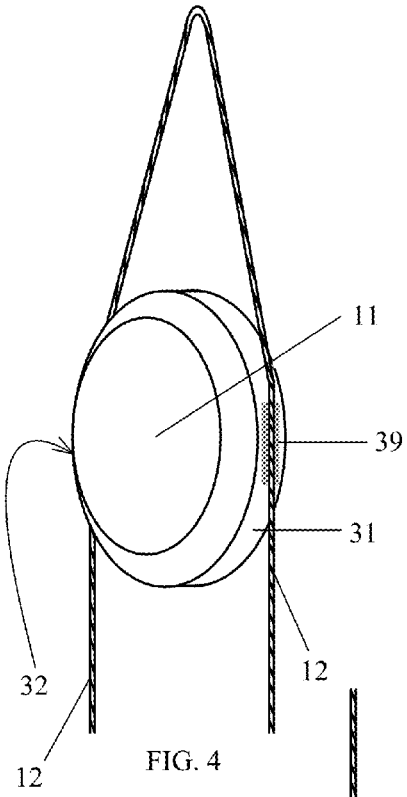
FIG. 4 is a perspective view of a suspended frangible target according to an alternate embodiment having a single suspending cord adhesively secured to both sides of the target.
Figure 5:
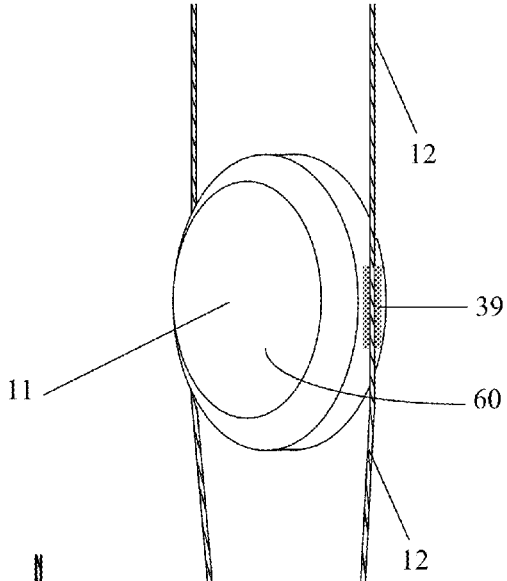
FIG. 5 is a perspective view of a suspended frangible target according to an alternate embodiment utilizing two suspending cords adhesively secured one each to the sides of the target.
Figure 5:
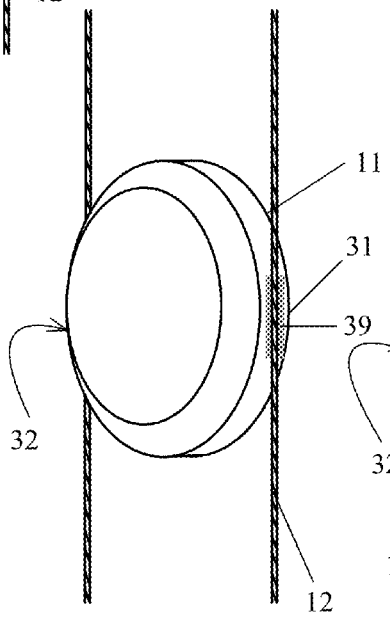
Figure 6:
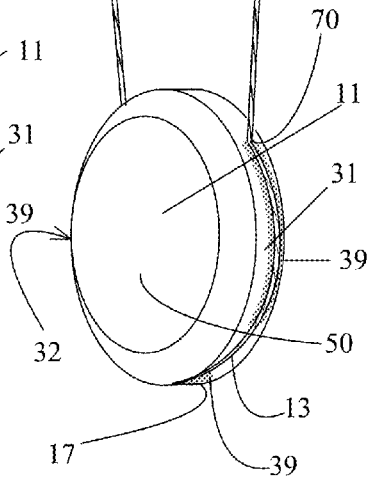
FIG. 6 is a perspective view of a suspended frangible target according to an alternate embodiment having a single suspending cord adhesively secured to both sides of the target and passing under and supporting the lowest target.
Figure 7:
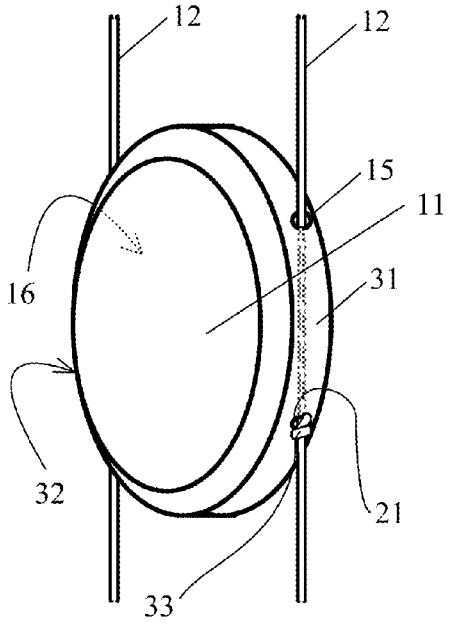
FIG. 7 is a perspective view of a suspended frangible target according to an alternate embodiment having suspending cords secured to the target by passing through apertures in the sides of the target, shown with a lower retaining knot.

Referring now more specifically to FIG. 2, illustrated therein is an alternate embodiment of frangible target suspension apparatus 10, wherein the alternate embodiment of FIG. 2 is substantially equivalent in form and function to that of the preferred embodiment detailed and illustrated in FIGS. 1, 13 and 14 except as hereinafter specifically referenced. Specifically, the embodiment of FIG. 2 comprises horizontal frangible target support 20, wherein horizontal frangible target support 20 comprises frangible targets 11 and support cords 12, and wherein support cords 12 comprise left ends 90 and right ends 95, and wherein ends 90, 95 comprise loops 14. Frame 100 comprises top rail 101, left rail 102 and right rail 103. Horizontal frangible target support 20 is secured in a horizontal disposition by securing loops 14 over any suitable fastener, such as, for exemplary purposes only, a plurality of hanging pegs/nails 40, wherein said plurality of hanging pegs is selectively disposed in left rail 102 and right rail 103, or, alternatively, disposed at opposite ends of top rail 101.

Figure 3:
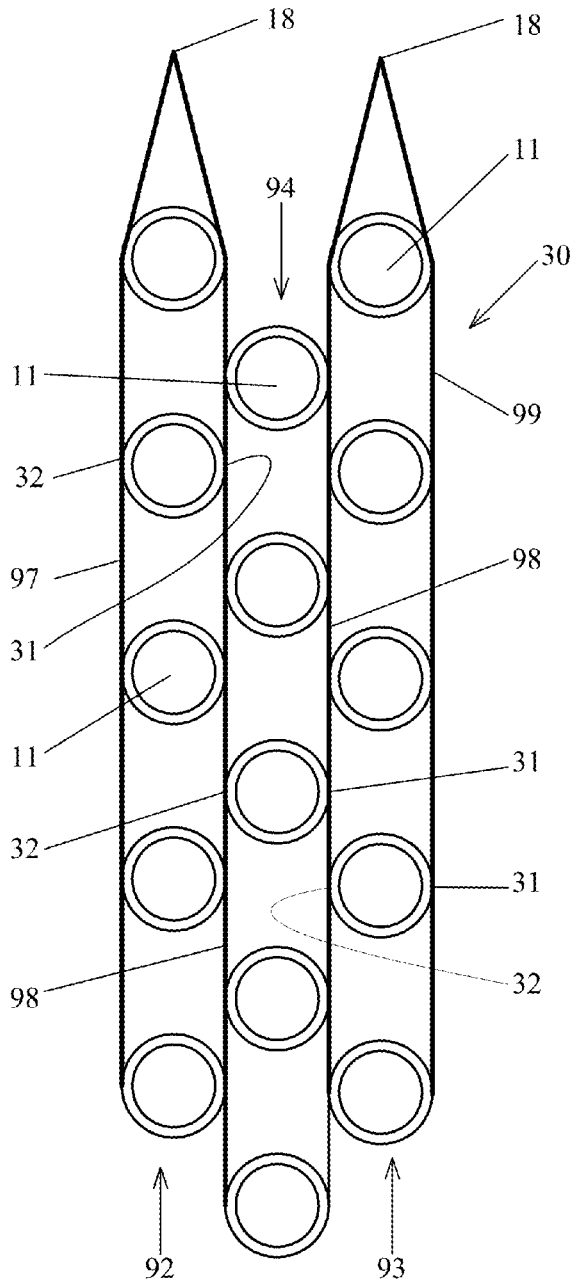
FIG. 3 is a front view of a frangible target suspension system with multiple columns of interconnected targets according to an alternate embodiment, shown suspended vertically.

Referring now more specifically to FIG. 3, illustrated therein is an alternate embodiment of frangible target suspension apparatus 10, wherein the alternate embodiment of FIG. 3 is substantially equivalent in form and function to that of the preferred embodiment detailed and illustrated in FIGS. 1, 13 and 14 except as hereinafter specifically referenced. Specifically, the embodiment of FIG. 3 comprises multi-strand frangible target support 30, wherein multi-strand frangible target support 30 comprises a plurality of frangible targets 11 staggered in height and supported by left outer support cord 97, right outer support cord 99 and inner support cords 98, wherein each of inner support cords 98 is secured via means disclosed hereinabove alternately to right side 31 of one frangible target 11 and to left side 32 of another frangible targets disposed higher or lower than the previous frangible target 11, wherein frangible targets 11 alternate in height between leftmost column 92 and middle column 94 and between rightmost column 93 and middle column 94. It will be recognized by those skilled in the art that middle column 94 could comprise a plurality of middle columns 94. Left outer support cord 97 is secured via means disclosed hereinabove to left sides 32 of frangible targets 11 in leftmost column 92, and right outer support cord 99 is secured via means disclosed hereinabove to right sides 31 of frangible targets 11 in rightmost column 93. Multi-strand frangible target support 30 comprises a plurality of apexes 18 for support by fastening over a respective plurality of hanging pegs/nails 41 (best shown in FIG. 14). Further, multi-strand frangible target support 30 is particularly suited for stacking as best depicted in FIG. 13.

Figure 15:
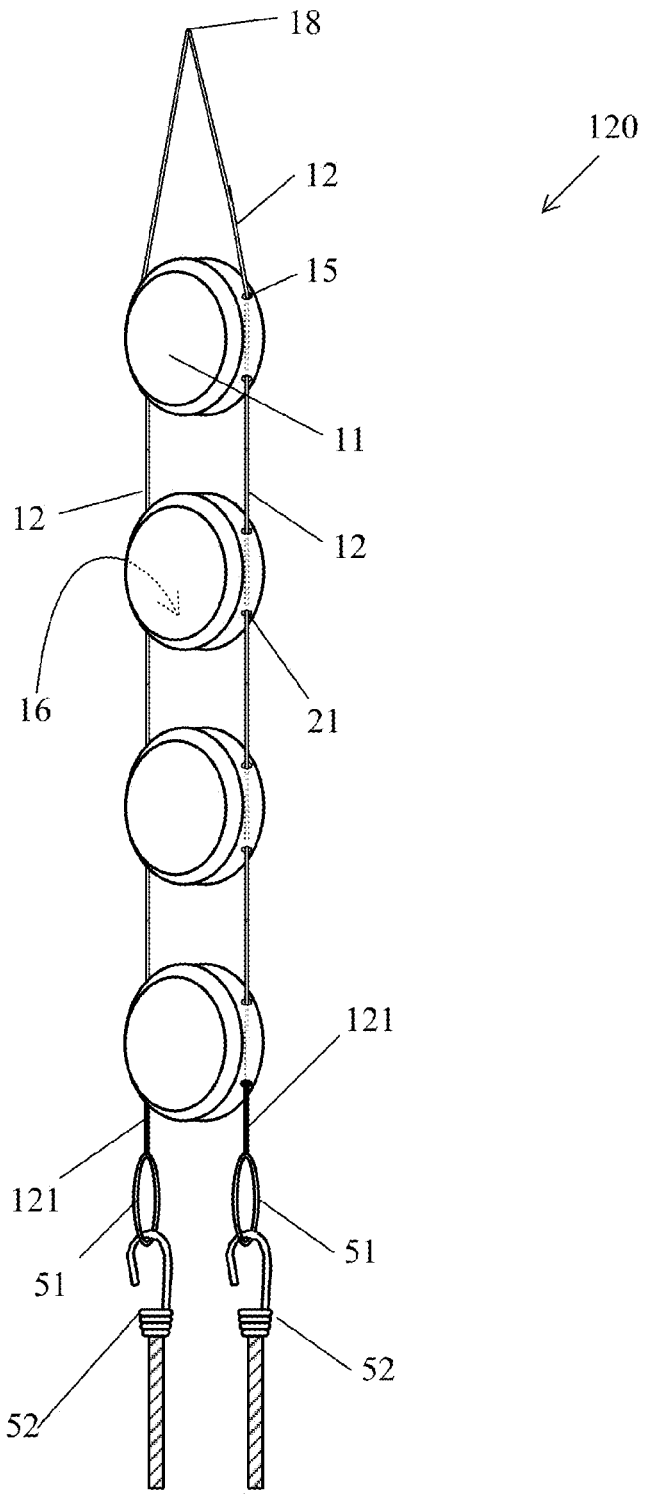
FIG. 15 is a perspective view of a suspended frangible target according to an alternate embodiment having a single suspending cord secured to both sides of the targets with loops below the lowest target.

Referring now more specifically to FIG. 15, illustrated therein is an alternate embodiment of frangible target suspension apparatus 10, wherein the alternate embodiment of FIG. 15 is substantially equivalent in form and function to that of the preferred embodiment detailed and illustrated in FIGS. 1, 13 and 14 except as hereinafter specifically referenced. Specifically, the embodiment of FIG. 15 comprises frangible target suspension apparatus 120, wherein frangible target suspension apparatus 120 comprises frangible targets 11 and support cord 12, and wherein frangible targets 11 comprise inside 16, upper throughholes 15 and lower throughholes 21. Support cord 12 comprises apex 18 and loops 51 wherein loops 51 are disposed at bottom 121 of frangible target suspension apparatus 120, and wherein support cord 12 secures each frangible target 11 of frangible target suspension apparatus 120 by passing through upper throughhole 15 to inside 16 and from inside 16 through lower throughhole 21. Frangible targets 11 are retained in position on support cord 12 by weight of frangible targets 11 which pulls support cord 12 taught, binding same in throughholes 15, 21. In an alternate embodiment of frangible target suspension apparatus 120, bungee cord 52 could connect loops 51 with support cord 12. To use, frangible target suspension apparatus 120 is placed in service by disposing apex 18 over hanging pegs/nails 41 (best shown in FIG. 14). It will be recognized by those skilled in the art that apex 18 could be replaced by at least one loop 51.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A frangible target suspension apparatus comprising:

at least one frangible target having edges opposite one another, wherein said opposite edges have rear-facing slots; and at least one support cord, wherein said support cord is secured to said rear-facing slots of said at least one frangible target, and wherein said at least one frangible target hangs suspended from said at least one support cord.

2. The frangible target suspension apparatus of claim 1, wherein said frangible target suspension apparatus is disposed generally vertically.

3. The frangible target suspension apparatus of claim 1, wherein said frangible target suspension apparatus is disposed generally horizontally.

4. The frangible target suspension apparatus of claim 1, wherein said support cord is secured by passing said support cord through said rear-facing slots in said at least one frangible target, and wherein tension of said support cord is caused by weight of said at least one frangible target, and wherein said tension binds said support cord to said frangible target via contact with said rear-facing slots.

5. The frangible target suspension apparatus of claim 1, wherein portions of said at least one support cord are secured at a high point on both of said opposite edges of said at least one frangible target.

6. The frangible target suspension apparatus of claim 1, wherein said at least one frangible target comprises a bottommost target, and wherein said at least one support cord passes under said bottommost target of said frangible targets.

7. The frangible target suspension apparatus of claim 1, wherein said at least one support cord comprises a single support cord, and wherein said single support cord comprises an apex for securing over a fastener.

8. The frangible target suspension apparatus of claim 1, wherein said at least one support cord comprises at least two support cords.

9. A method of suspending frangible targets, said method comprising the steps of:

securing at least one frangible target, having edges opposite one another, wherein said opposite edges have rear-facing slots;

inserting said at lest one support cord into rear-facing slots, thereby retaining said at least one support cord within said at least one frangible target; and securing said at least one support cord to a frame, wherein said at least one frangible target hangs suspended from said at least one support cord.

10. The method of claim 9, wherein said opposite edges each has a pair of said rear-facing slots therein, and wherein said step of securing said at a least one frangible target to said at least one support cord further comprises the steps of:

passing said at least one support cord through said pair of said rear-facing slots; and retaining said at least one frangible target in position on said at least support cord via tension of said at least one support cord.

11. The method of claim 9, wherein said step of securing at least one frangible target to said at least one support cord further comprises the step of:

securing said at least one support cord to a high point on each of said opposite edges.

* * * * *